US005233320A

United States Patent [19]

Evans

[11] Patent Number: 5,233,320

[45] Date of Patent: Aug. 3, 1993

[54] COMPACT MULTIPLE CHANNEL ROTARY JOINT

[76] Inventor: Gary E. Evans, 1198 Stoney Run Rd., Hanover, Md. 21673

[21] Appl. No.: 620,491

[22] Filed: Nov. 30, 1990

[51] Int. Cl.[5] ..... H01P 1/06

[52] U.S. Cl. ..... 333/261; 343/763

[58] Field of Search ..... 333/256, 257, 261; 343/763

[56] References Cited

U.S. PATENT DOCUMENTS

| | | | |
|---|---|---|---|
| 3,123,782 | 3/1964 | Parisi | 333/257 |
| 4,258,365 | 3/1981 | Hockham et al. | 343/763 |
| 4,358,746 | 11/1982 | Miller et al. | 333/261 |
| 4,427,983 | 1/1984 | Kruger et al. | 333/261 X |
| 4,516,097 | 5/1985 | Munson et al. | 333/261 |
| 4,543,549 | 9/1985 | Meltzer et al. | 333/256 |

FOREIGN PATENT DOCUMENTS

| | | | |
|---|---|---|---|
| 8804835 | 6/1988 | PCT Int'l Appl. | 333/261 |
| 1290434 | 2/1987 | U.S.S.R. | 333/261 |

OTHER PUBLICATIONS

Fromm, W. E., et al; "A New Microwave Rotary Joint"; 1958 *IRE Nat'l. Convention Record;* vol. 6, Part 1; pp. 78–82.

Cohen, Morris; "A Six-channel Vertically Stacked Coaxial Rotary Joint for S, C, & X-band Region"; *The Microwave Journal;* Nov. 1964; pp. 71–74.

*Primary Examiner*—Robert J. Pascal
*Assistant Examiner*—Benny T. Lee
*Attorney, Agent, or Firm*—M. P. Lynch

[57] ABSTRACT

A multiple channel rotary joint design is described in which the channel components are laid out in a manner to reduce the number of layers of microwave circuitry necessary to provide rotary coupling with the antenna. The reduction of layers in each channel allows room for larger conductors in each channel, providing greater power handling capability. Compactness is also achieved through the use of a novel central extrusion that replaces the usual coaxial input lines, novel choke designs, and a novel stripline configuration that makes dual use of various components and minimizes losses within the joint. The central extrusion provides all the high power inputs, while allowing the passage through its center of a plurality of low power coaxial lines to low power channels residing on top of the high power channels. Cooling of the rotary joint is simplified by keeping the center of the joint stationary, and cooling air is fed through the transmission lines to make this function more efficient. One pair of bearings is used for the entire multiple channel joint rather than using individual channel bearings in order to reduce tolerance buildup and weight. The use of numerically controlled machining in the manufacturing process guarantees channel-to-channel reproducibility and achieves tolerances suitable for high performance chokes.

42 Claims, 15 Drawing Sheets

COMPACT MULTIPLE CHANNEL ROTARY JOINT

BACKGROUND OF THE INVENTION

The subject invention is a shipboard radar/antenna interface coupling system. Such systems, in which radio frequency (r.f.) signals must pass to the antenna from a transmitter located below decks, are well known in the art. In this particular type of radar system, the antenna rotates through 360 degrees of azimuth coverage. Therefore, a rotary coupling system is needed.

Shipboard radars require stabilized systems to maintain elevation coverage and also for beam steering to find height and target location. Innumerable techniques have been used, utilizing either large mechanical devices or active electronics on the antenna. These approaches often have reliability and maintenance problems. Radar systems having a rotary array with control of individual rows to form elevation beams, but having only straight-forward azimuth rotation, represent a sound, economical design. To simplify maintenance it is desirable that outputs from each row be brought off the rotating platform so that the electronics can be accessible and protected below decks. The present emphasis on solid state transmitters that combine the outputs of dozens of modules in a given space allows an alternative to mechanical devices and active antenna electronics: multiple rotary joints (see FIG. 1). Elevation steering is electronic, and takes place below decks. Each array row 2 is fed by at least one module with controllable phase. The phase shift can be accomplished at low power. By thus eliminating the electrical loss due to both the phase shifters and their combiners, the transmission line loss in the run up the mast becomes less critical. To be successful, this method requires multiple, high power, low loss, and phase stable rotary joint paths.

All 360 degree rotary joints must provide a circularly symmetric junction between the stationary and rotary paths, so that rotation can take place without signal variations caused by the coupling the term (WOW) as used in the industry as a variation of an electrical property of a rotary device as a function of rotation of the device through 360 degrees. Further, with N multiple paths, N−1 transmission lines must pass inside the largest coupler.

For up to three high power channels, concentric coaxial rotary joints of progressively smaller diameters are commonly used, with progressively less power handling from outer to innermost joint. Beyond three paths, stacking must be done vertically instead, using thin "pancake" joints 3. These have oversized, inner diameter holes 4 sufficiently large to allow the passage of all transmission lines 5 from the joints 3 to the antenna above them, as illustrated in FIG. 2*a* and 2*b*. This usually makes the circumference large in number of wavelengths, requiring multiple drive points around the joints 3 to obtain a uniform field at the circular junction. In order to transfer energy across this large diameter junction without sensitivity to rotation, each side must be uniformly driven. If the excitation points are spaced more than one wavelength apart on the circumference, at least two modes will propagate unattenuated at different velocities, and drastic variations with azimuth will occur. Even if driving points are closer than a wavelength, the attenuation to non-propagating modes is limited for short lengths of coax, so carefully designed input and output networks are required to meet a specified WOW level. Clearly the larger the diameter the more complex the driving network. For high power level and wide bandwidth, 1⅝" diameter coax might typically be required for input and output lines such as transmission lines 5. As shown in FIG. 5*a*, if densely packed into the inner diameter hole 4, at least a 10" diameter hole 4 would be required for the specific case considered herein in detail, using 21 high power lines and 6 low power lines, along with different styles of connections depending on where the coax was placed. If all were at a single radius, the diameter of hole 4 would reach 13", which would create serious design problems. The number of drive point taps required is directly proportional to the diameter, and the divider size is proportional to both, making the diameter of hole 4 the primary determinant of rotary joint unit size and weight.

Usually the entire outside of the rotary coupler is the stationary component, while the inside section rotates with the antenna. The input line divides into enough drive point taps to drive a low impedance coaxial line. The output has multiple taps as well to collect the signals, which are recombined at the antenna port. The rotor-to-stator junction itself must be a non-contacting type to allow rotation and to have significant life at high power. Normally a multiple section choke joint is employed to realize the junction, with the section impedances chosen to provide low VSWR across the band.

Such rotary couplers are not new to the art, but are usually associated with multiple low power applications, for the following reasons. If the many channels are to fit within the above decks antenna platform, they must be of minimum height and less than a specific diameter. Referring to FIGS. 3*a* and 3*b*, which show two planar cross-sections of the current state of the art in pancake joints, minimizing the size of joints is seen to be quite difficult. The joint has coaxial inputs and outputs, and uses many layers of microwave circuitry. In FIG. 3*a*, starting at the bottom, there is an inner conductor choke 6, an outer divider 8, a choke on the divider balun 10, an outer conductor choke 12, a combiner balun 14, a combiner 16, and a return of the combiner to the center 18. Each joint 3 is tied to the low impedance coax and each layer will function more effectively as its thickness increases, both in power handling and in bandwidth. With 1" striplines and 0.5" chokes provided to achieve desired power handling and bandwidth characteristics, 5" minimum thickness is required for each channel. This makes the system as it exists prohibitively large for high power applications. In high power applications, excessive heat may also be a problem in these prior art systems. Excessive heat must be avoided especially, as liquid cooling can be difficult on board ship; any cooling system used must be kept simple and reliable.

Since each of these prior art channels contains chokes, baluns, and transformers, bandwidth is often limited and losses are moderately high. Large conductors can be used, as they have a higher peak power capacity. However, the large dimensions strain the size and weight limitations and put a premium on optimal location of each part and on mechanical design. Also, larger conductors can be significant fractions of a wavelength wide, complicating the already difficult task of microwave design over the wide bandwidth.

Also, in most conventional designs of pancake modules, each channel is entirely self contained, with its own bearing or bearings. Assembly of several channels into a package involves stacking the required number of modules one above another, with some method of tying the stators and rotors of each module to its neighbors. This process necessarily gives rise to concentricity and alignment problems. Also, because the individual module bearings are relatively small, and undergo continuous use, bearing loads can become quite high, with resultant short bearing life.

In addition, when individual module bearings are used, the module design is often complicated by the need to shield the bearings from r.f. energy, particularly in a high power module. Improperly shielded bearings may arc in the presence of r.f., seriously reducing their lifetimes, or resulting in catastrophic failure. To protect them requires extensive choke and load designs modification.

What is needed is a design that will accommodate a high average power r.f. signal with a large bandwidth, that is of compact size and weight, and that suffers low losses in order to keep temperatures reasonable and has facilities for cooling to permit high power level use.

SUMMARY OF THE INVENTION

Therefore, it is a broad object of the present invention to provide a novel and improved multiple channel radar joint for use with a radar system.

It is also a general object of the present invention to provide a novel multiple channel rotary joint that is significantly more compact than prior art joints, while also having less loss, and improved power and bandwidth handling capabilities.

A further object of the present invention is to provide a novel low loss design for a multiple channel rotary joint which minimizes heat by utilizing maximum conductor sizes, minimal use of dielectric, and a minimal number of mechanical connections, and allows for air cooling.

Another object of the present invention is to provide a novel layout of transmission lines within the multiple channel rotary joint in order to minimize losses within the joint.

It is also an object of the present invention to provide a novel means for making the center of a multiple channel rotary joint stationary so that this concentrated power region can be cooled with a stationary forced-air system.

It is another object of the present invention to provide a novel means for feeding cooling air through the lines rather than around them for better heat transfer from the critical center conductors and in order to share the space between the two functions.

It is also an object of the present invention to provide a novel replacement of the traditional multitude of central coaxial lines with a custom multiple channel extrusion to make better use of the feasible area allowed per channel.

Yet another object of the present invention is to provide a novel means for minimizing volume and weight by multiple usage of parts for microwave, thermal, and structural purposes.

It is also an object of the present invention to provide a novel use of one pair of large bearings rather than individual channel bearings to reduce tolerance buildup and weight.

Another object of the present invention is to provide a novel use of numerically controlled machining throughout to reduce piece parts count to a minimum, to eliminate junctions, to guarantee channel-to-channel reproducibility, and to achieve tolerances suitable for high performance chokes.

These objects and others are achieved by a multiple channel rotary joint design in which the channel components are laid out in a manner to reduce the number of layers of microwave circuitry necessary to provide rotary coupling with the antenna. The reduction of layers in each channel allows room for larger conductors in each channel, providing greater power handling capability. Compactness is also achieved through the use of a novel central extrusion that replaces the usual coaxial input lines, novel choke designs, and a novel stripline configuration that makes dual use of various components and minimizes losses within the joint. The central extrusion provides all the high power inputs, while allowing the passage through its center of a plurality of low power coaxial lines to low power channels residing on top of the high power channels. Cooling of the rotary joint is simplified by holding the center of the joint stationary, and cooling air is fed through the transmission lines to make this function more efficient. One pair of bearings is used for the entire multiple channel joint rather than using individual channel bearings in order to reduce tolerance buildup and weight. The use of numerically controlled machining in the manufacturing process guarantees channel-to-channel reproducibility and achieves tolerances suitable for high performance chokes.

DETAILED DESCRIPTION OF A PREFERRED EMBODIMENT

The subject invention is a shipboard radar/antenna interface coupling system. In this particular type of radar system, the antenna rotates through 360 degrees of azimuth coverage. Therefore, a rotary coupling system, such as the multiple channel rotary joint of the present invention, is needed. The particular radar system to which the present invention is applied requires a high power, wide bandwidth signal output.

Figure 4:
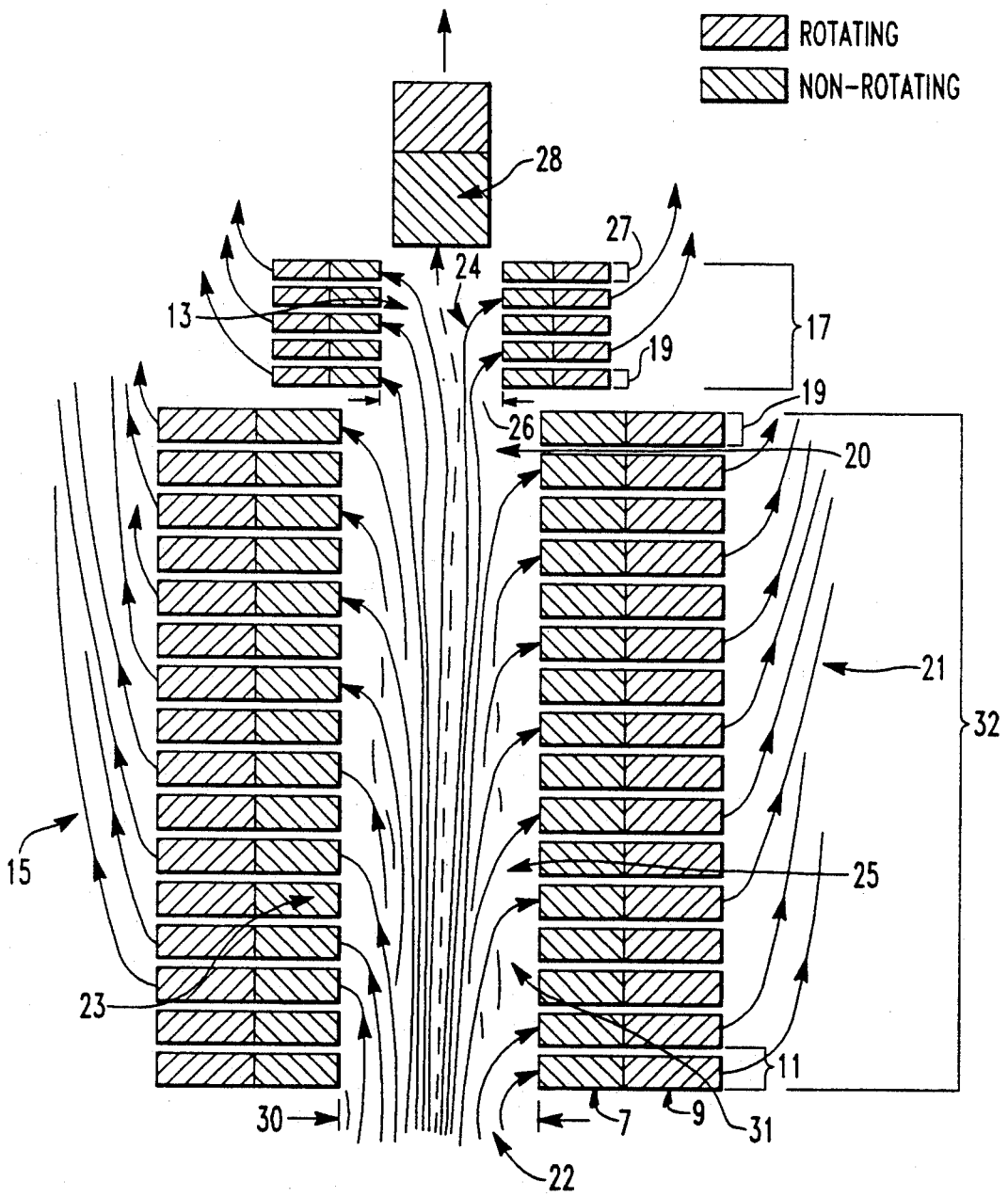
FIG. 4 is a sectional illustration of the grouping of the rotary joints of the present invention.

As shown in FIG. 4, the multiple channel rotary joint 21 of the present invention comprises a plurality of "pancake" channels 19 stacked one on top of another. In the system of the present invention, the rotary joint 21 will employ both high power signals and low power signals, creating the need for separate high and low power channels, 11 and 27 respectively. These may be arranged into separate stacks of channels, the high power stack 32 and the low power stack 17. Each channel 19 is of a circular disk shape with a round center hole 31. Each channel 19 is split into an inner section 7 and an outer section 9. Feeder transmission lines 22 are fed from below decks to interface with each channel 19 on the inside face of the center hole 31. The feeder transmission lines 22 include low power lines 24 and high power lines 25 and provide r.f. signals to the inner sections 7 of the channels 19, which remain stationary. The signals are processed through the use of microwave circuitry, as will be described in detail, and are transmitted to the outer section 9 of each channel 19. Additional antenna interface transmission lines 15 pass upward to the antenna from the outside of the outer sections 9 of the channels 19, which rotate with the antenna (not shown). Because there are many more channels in high power stack 32 than there are channels in low power stack 17, fewer feeder transmission lines 22 pass to and from the channels of low power stack 17. Because fewer feeder transmission lines 22 will pass through the low power channel inner diameter holes 13, these low power channel inner diameter holes 13 are smaller than those of the channels 19 in high power stacks 32, and the low power stack 17 can preferably therefore sit on top of the high power stack 32 and be fed through the center holes 31 of high power stack 32. The low power stack 17 therefore only requires an inner hole diameter 26 sufficient for the low power lines 24, allowing smaller, simpler channel designs to be used in the low power stack 17. An Identification Friend or Foe (IFF) channel 28 requires only one line and a conventional concentric rotary joint, and sits on top of the entire stack.

The inner channel diameter 30 of the high power stack 32 of rotary joint 21 required to pass all of the feeder transmission lines 22 up the center of the rotary joint 21 is critical to the design of the individual channels 19. This inner channel diameter 30 is determined by the size, type, and quantity of feeder transmission lines 22 required. The central passage 20, defined by the center holes 31 of the stacked channels 19, has the most difficult access and the highest concentration of heat among various regions of the assembly of rotary joint 21. The central passage 20 is therefore important for providing simplification, loss minimization, and heat removal in the rotary joint 21.

Figure 1:
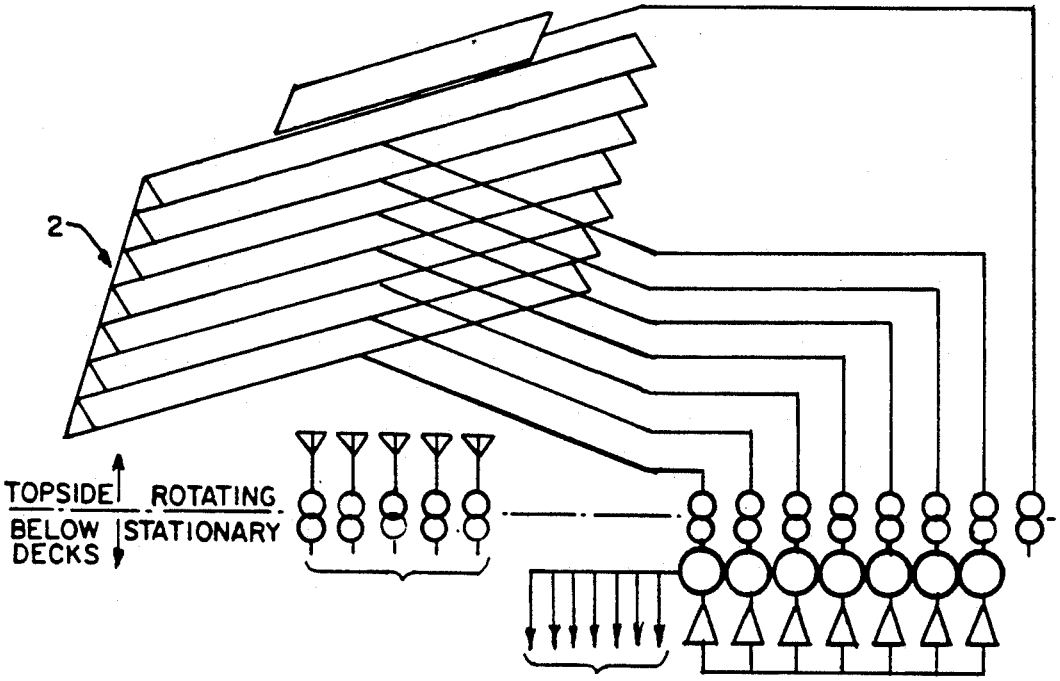
PRIOR ART FIG. 1.
FIG. 1 is a diagram of a typical multiple channel rotary joint as used in the prior art.
Figure 5A:
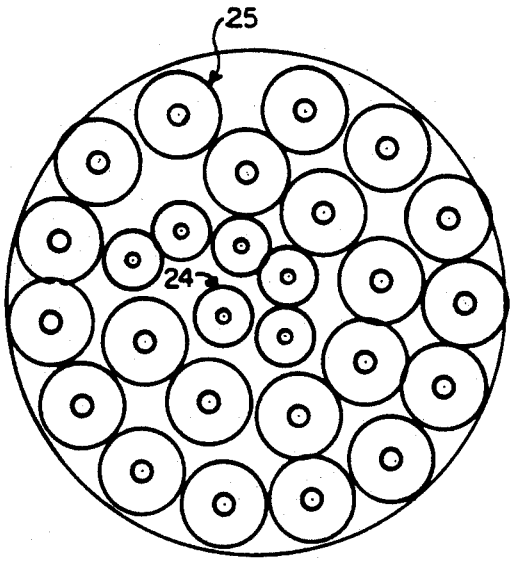
PRIOR ART FIG. 5A.
FIG. 5*a* is a cross-sectional view of the central spline of a prior art rotary coupler, showing the use of coaxial cables.
Figure 5B:
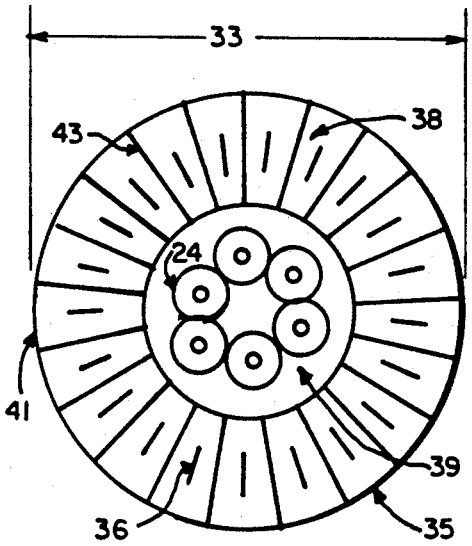
FIG. 5*b* is a cross-sectional view of the central extrusion of the present invention, showing the use of radial stripline channels.
Figure 2A:
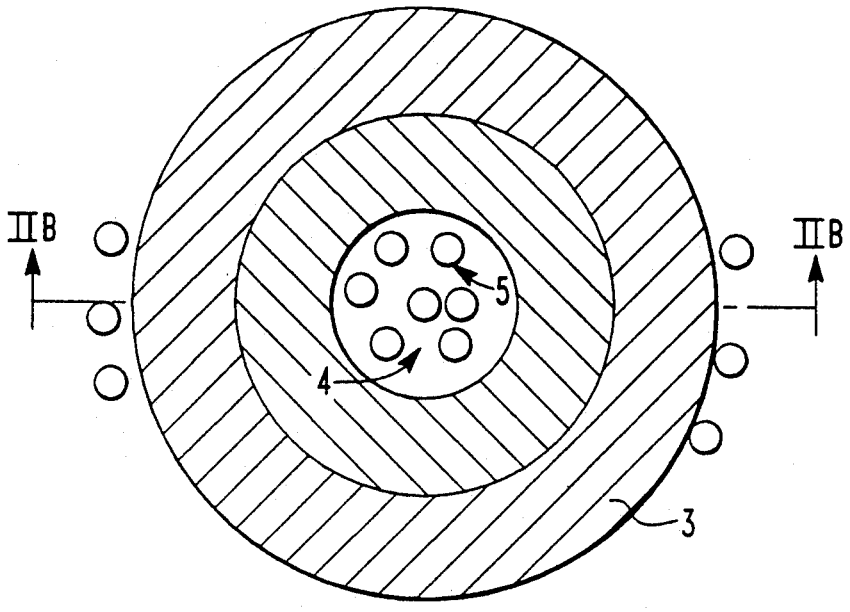
PRIOR ART FIG.2A
FIGS. 2*a* and 2*b* make up a sectional assembly drawing showing the prior art method for stacking channels in a multiple rotary joint.
Figure 2B:
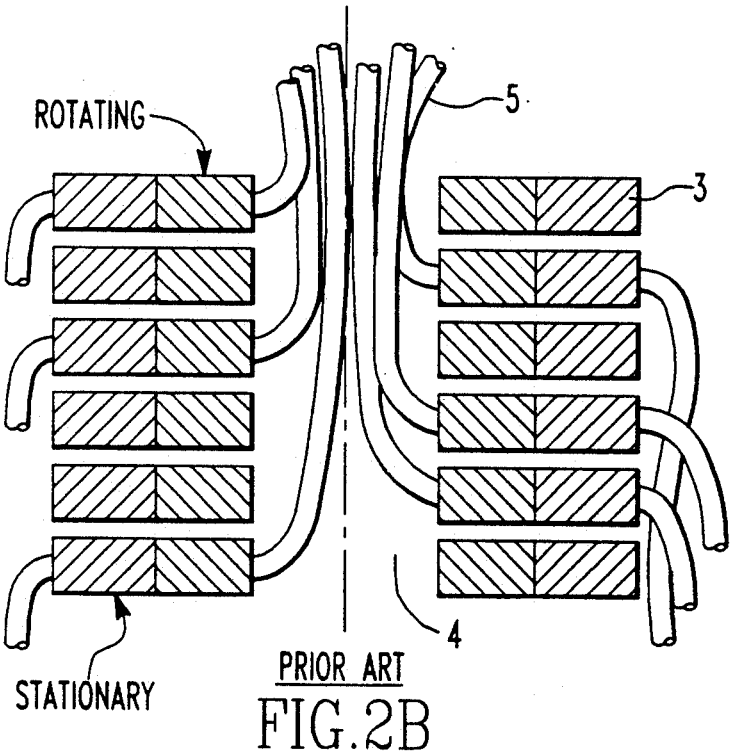
PRIOR ART FIG.2B

With this in mind, in the preferred embodiment, the rotary joint 21 uses a special design to carry feeder transmission lines 22, as shown in cross-section in FIG. 5*b*. In this embodiment, an extruded spline 35 is placed in the central passage 20 of high power stack 32. The extruded spline 35 has a disk-shaped cross-section surrounding a center hole 39. The outer diameter 33 of the extruded spline 35 is preferably equal to the internal channel diameter 30 of the high power stack 32. The center hole 39 is about half the outer diameter 33 in size and is provided to pass low power lines 24. In this example the extruded spline 35 contains twenty-one passages 38 for the twenty-one channels 19 in high power stack 32, with six low power lines 24 shown occupying the center hole 39. Each passage 38 has a cross section which is an arc region of the extruded spline 35, having as its boundaries the wall defining center hole 39, the outlet wall 41 defining the outer perimeter of extruded spline 35, and two cross walls 43 occupying planes intersecting the central longitudinal axis of the extruded spline 35. In general, the cross walls 43 will be separated by 2*PI/n radians of arc, where n is the number of channels in rotary joint 21, although a smaller arc could also be used to leave unused space for passages 38. Each passage 38 contains a coaxial rectangular or circular center conductor, stripline 36. As comparison with the prior art coaxial approach (shown in FIG. 5*a*) reveals, the elimination of empty spaces and the use of common walls enables the use of a smaller inner channel diameter 30 (extruded spline outer diameter 33) while still having a clear central passage 20 for the low power lines 24.

Figure 6A:
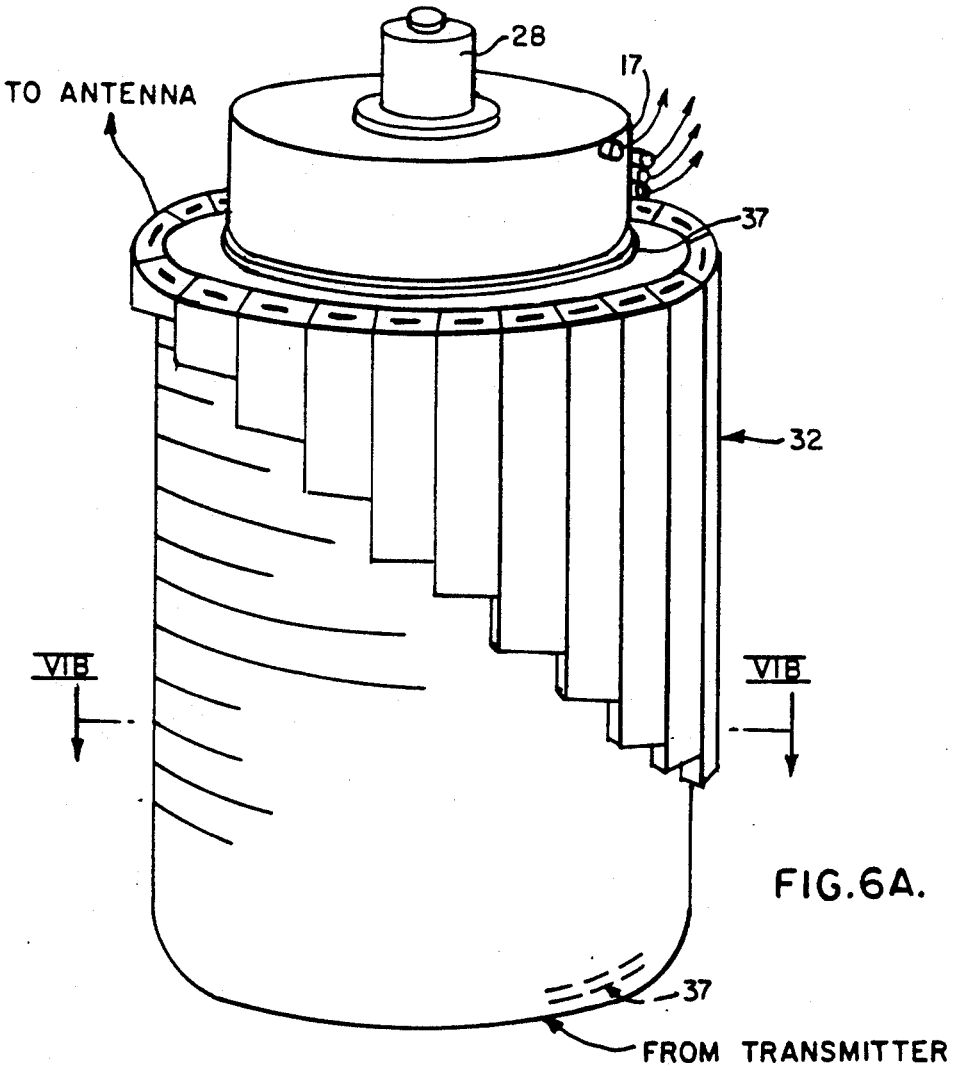
FIG. 6*a* and 6*b* are a perspective drawing of the multiple channel rotary coupler of the present invention.
Figure 6B:
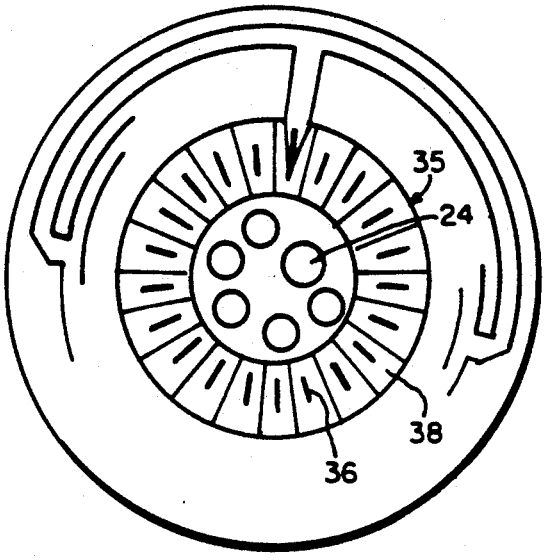

By arranging the striplines 36 on a common circumference in the one piece extrusion of extruded spline 35, each channel junction is made identical. Every high power channel 11 has a similar right angle connection into the extruded spline 35 and out of it. The extruded spline 35 also aids the alignment of the high power stack 32, serves as a natural finned heat conductor from the high power channels 11 and, as will be described in detail later, provides inlet passages for forced air cooling. Finally, as shown in FIGS. 6*a* and 6*b*, the extruded spline 35 (see FIG. 6*b*) forms the main structural member to position and support the individual high power channels 11 and is rigid enough that a single pair of angular contact bearings 37 (see FIG. 6*a*), rather than the usual bearing or bearings associated with each individual channel, is sufficient to maintain concentricity for the twenty-one high power channels 11. By divorcing the bearings 37 from the individual modules, and applying one bearing 37 at each end of the extruded spline 35 about which the modules are assembled, bearing alignment problems are greatly reduced, and the possibility of r.f. induced failure is eliminated. The two bearings 37 used are of large diameter and cross section, permanently lubricated and sealed.

Figure 7:
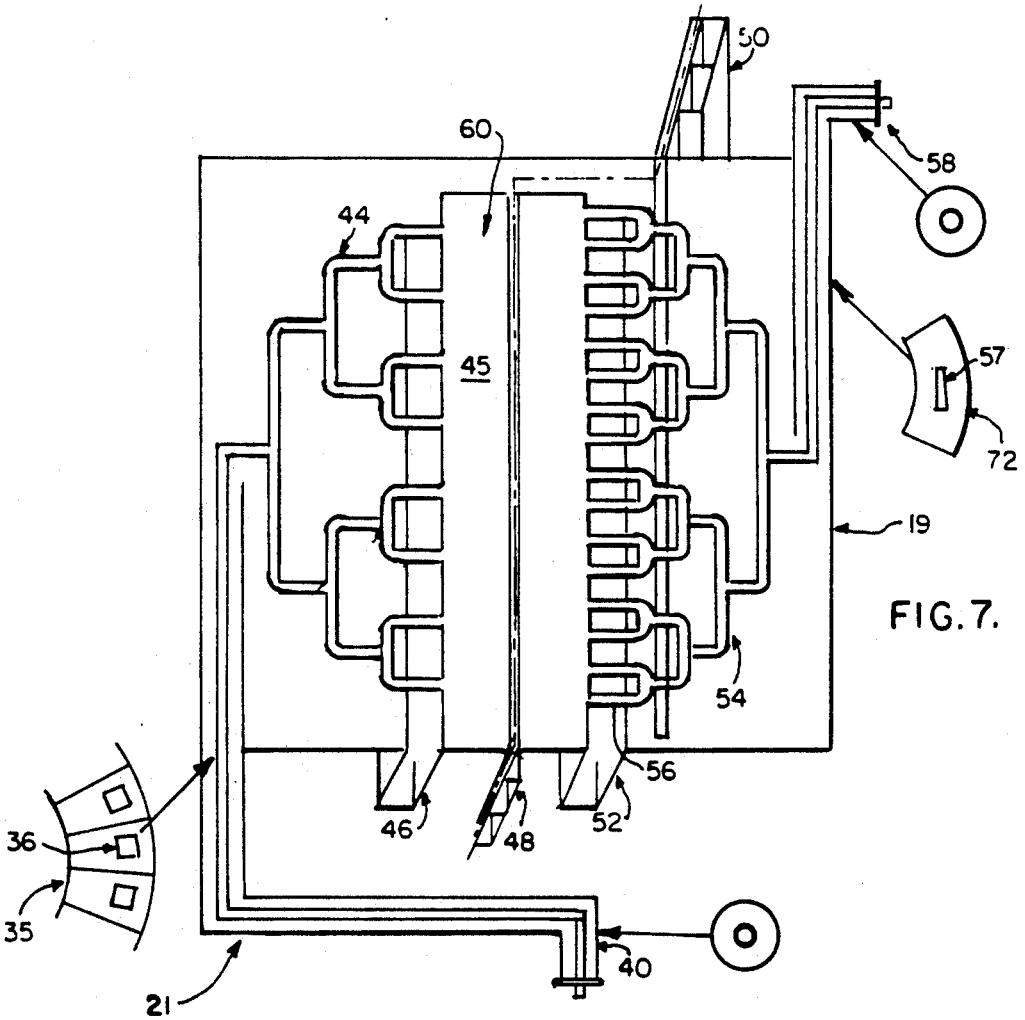
FIG. 7 shows the components necessary to construct a pancake style of rotary coupler, with the cylindrical channel signal path rolled out to view.

The circuits necessary to construct a pancake style high power channel 11 of a rotary joint 21 are shown in FIG. 7, in which the cylindrical channel signal path is rolled out to view. The high power signal enters the rotary joint 21 on the input stripline 40 that becomes the extruded spline stripline 36. The signal is split into eight taps 45 at the divider 44 in order to uniformly drive the circular rotary joint 21, and a divider balun 46 is used to balance the junction of the 3-wire input stripline 40 and the 2-wire low impedance section, central coax 60. The signal then passes across the interface between rotating and stationary portions of the central coax 60, defined by divider choke 48 and combiner choke 50. The combiner balun 52 then returns the signal to the 3-wire output stripline 56, where it is recombined at combiner 54. The signal then flows to the channel output 58 via the center conductor stripline 57 of output extrusion 72, and on to the antenna.

Figure 3A:
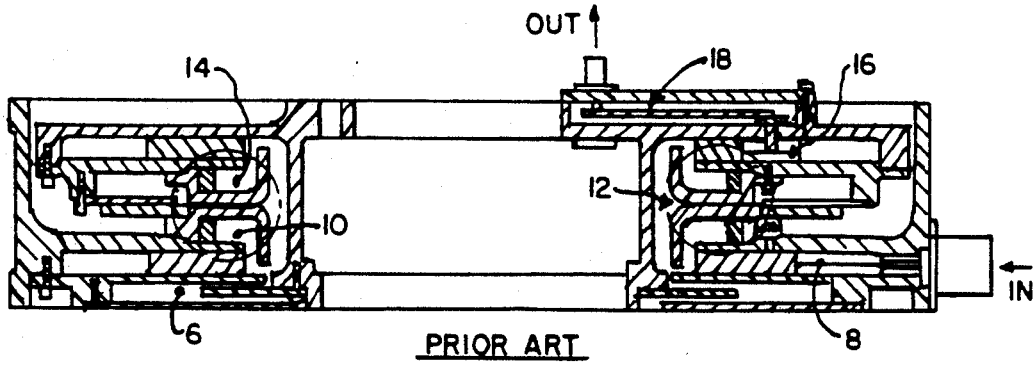
PRIOR ART FIG. 3A.
FIGS. 3*a* and 3*b* are sectional assembly drawings showing a a top view and side view of a prior art pancake joint.
Figure 3B:
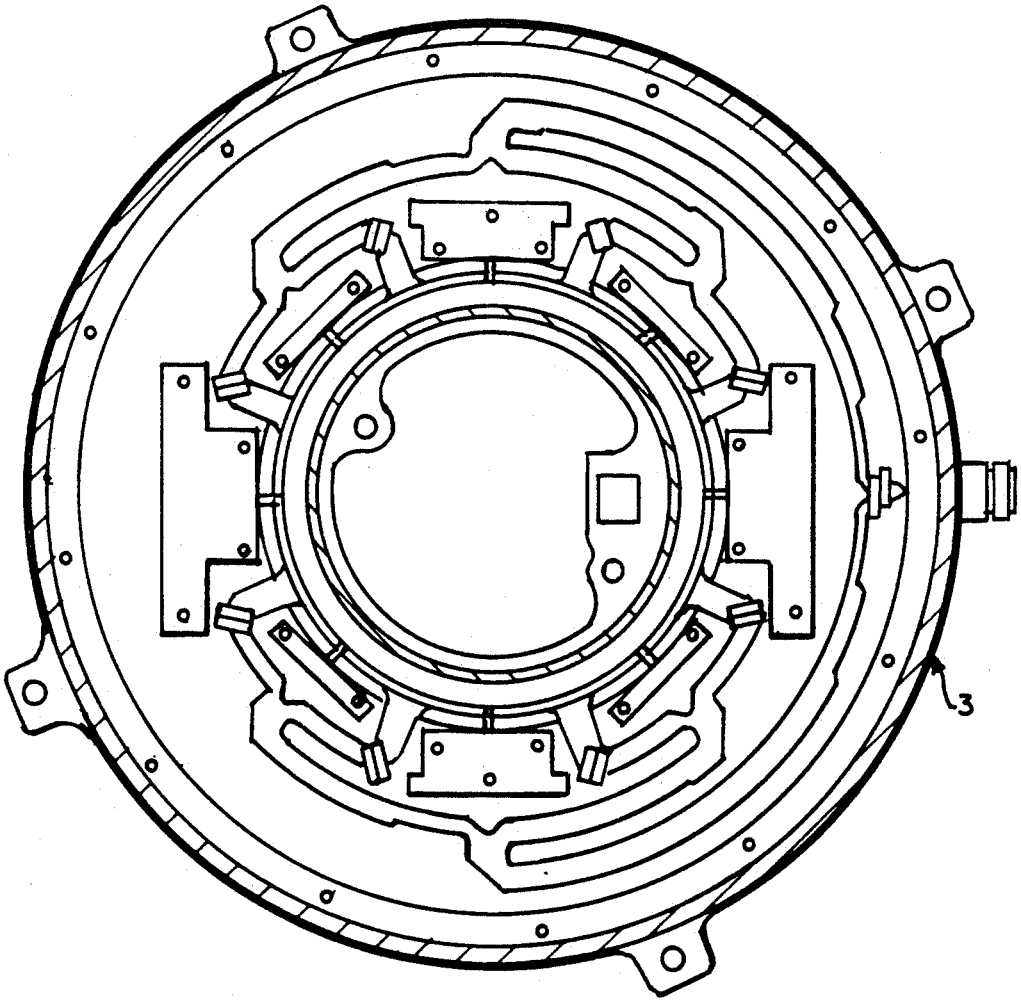
PRIOR ART FIG. 3B.
Figure 8:
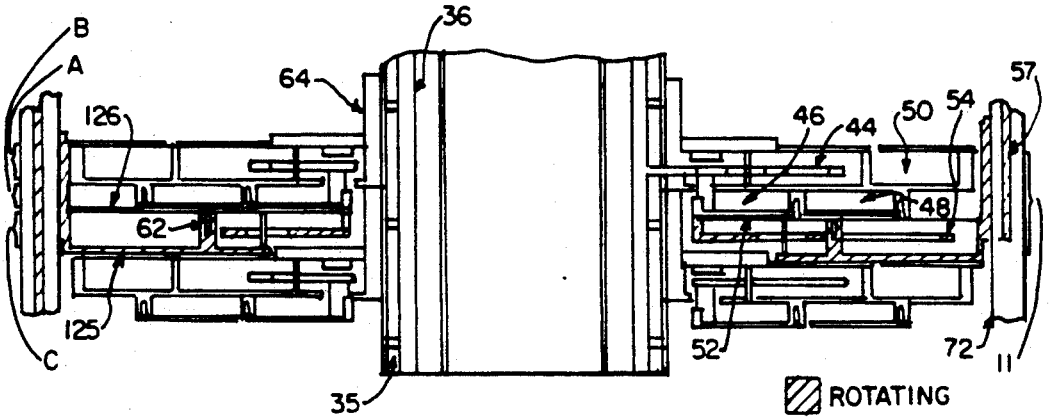
FIG. 8 is a cross-section of a high power channel according to the present invention.

If 21 of these high power channels 11 are to fit in a stack 63" in height, as required in this example, each high power channel 11 must be less than 3" tall. Within this space the present invention must divide to the taps 45, balance the junction from 3-conductor stripline to the nearly parallel plate 2-wire low impedance section, central coax 60, provide sufficient conductor length to suppress higher modes, break and choke the conductors, and recombine the taps on the rotating end while again balancing the junction. In the prior art, as illustrated in FIG. 3, implementing these features would require 6 to 7 layers, each sufficiently thick to handle both the power and the bandwidth required. In order to reduce the number of layers needed, the present invention is constructed with a vertical cross-sectional arrangement as shown in FIG. 8. As shown, the high power channel 11 is made up of six major parts: the rotating backbone 62, stationary backbone 64, stripline divider 44, stripline combiner 54, extruded spline 35, and output extrusion 72, which carries vertical output stripline 57. The stationary backbone 64 and the rotating backbone 62 are shaped to form the baluns 46, 52 and the chokes 50, 48.

The following steps have been taken in the preferred embodiment in order to reduce the number of layers in each high power channel 11. The divider 44 is made a single plane, with its return to center built in, eliminating one layer at the sacrifice of circular symmetry. The divider 44 diameter is constrained sufficiently to allow the thick (high impedance) portion of the combiner choke 50 of the adjacent high power channel 11 to lie outside of it instead of on top of it, eliminating most of another layer. The divider balun 46 is a separate layer, but shares a layer with the thick portion of the divider choke 48. Finally, the combiner 54, which exits on the outside and therefore has symmetry at the center, shares a layer with its associated balun 52, eliminating one more layer. The net result is that the cross section of high power channel 11 is arranged in three layers, with a total thickness of 2.8". The uppermost layer, Layer 1, comprises the divider space. The combiner choke 50 for the adjacent high power channel 11 (above the high power channel 11 shown) also occupies this layer, lying outside the divider 44 on the outer perimeter of the high power channel 11. The middle layer, Layer B, is occupied by the divider balun 46 and the divider choke 48. The bottom layer, Layer C, is taken up by the combiner 54 and the combiner balun 52; the corresponding combiner choke resides on the outer edge of Layer A of the channel immediately below.

Figure 9:
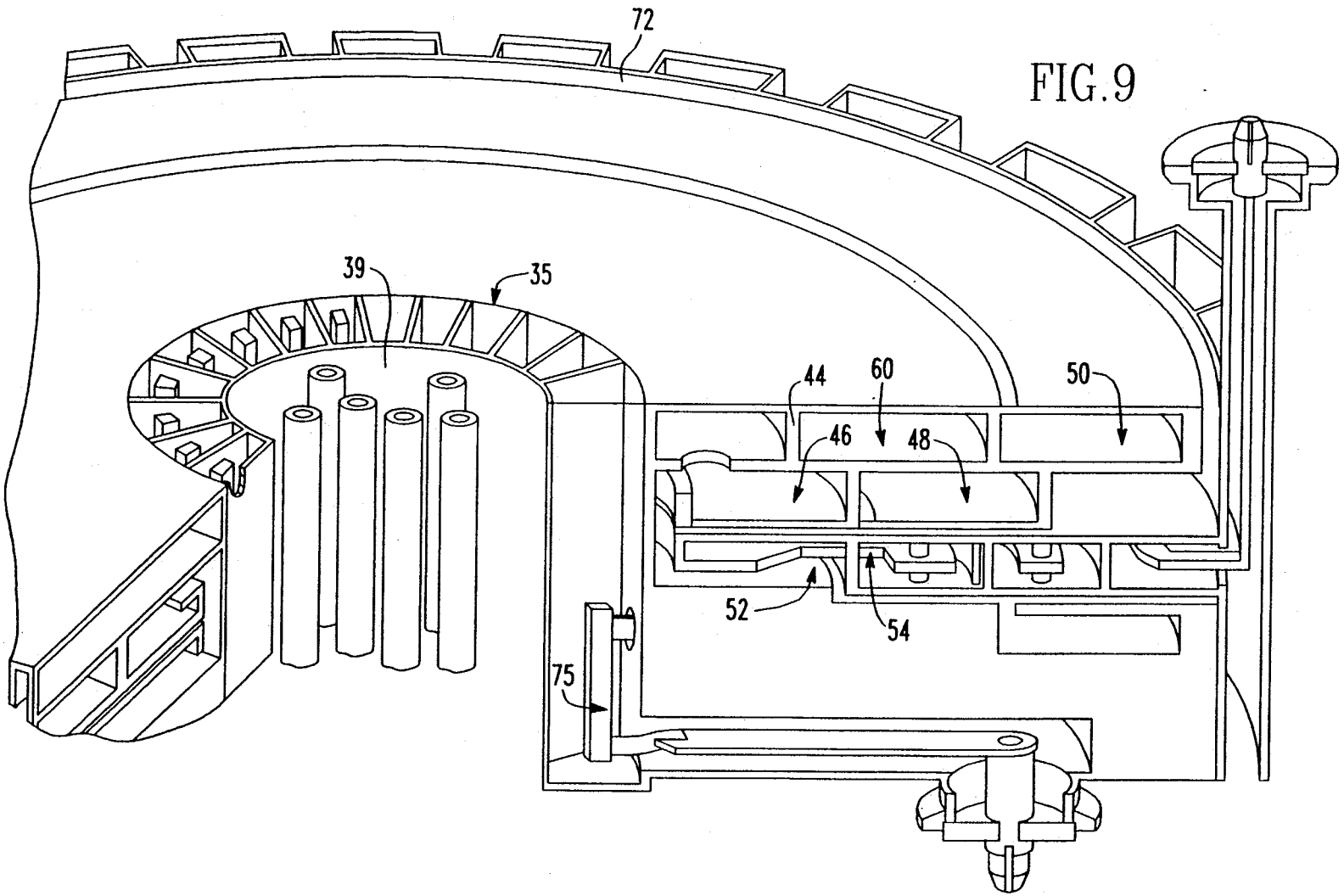
FIG. 9 is an assembly drawing showing a channel of the rotary coupler of the present invention in cross-section.

The resulting system is shown assembled in perspective in FIG. 9. The extruded spline 35 carries the stationary inputs 75 up to the individual high power channels 11. The break point between stationary and rotating sections of each high power channel 11 occurs at a relatively large diameter. Therefore, that large diameter transmission line, central coax 60, is driven at many places on its circumference, thereby avoiding moding and consequent WOW. The driving divider 44 and the combiner 54 to the output utilize air-dielectric stripline. Maximum line sizes for the space available are used throughout to minimize loss.

Figure 10:
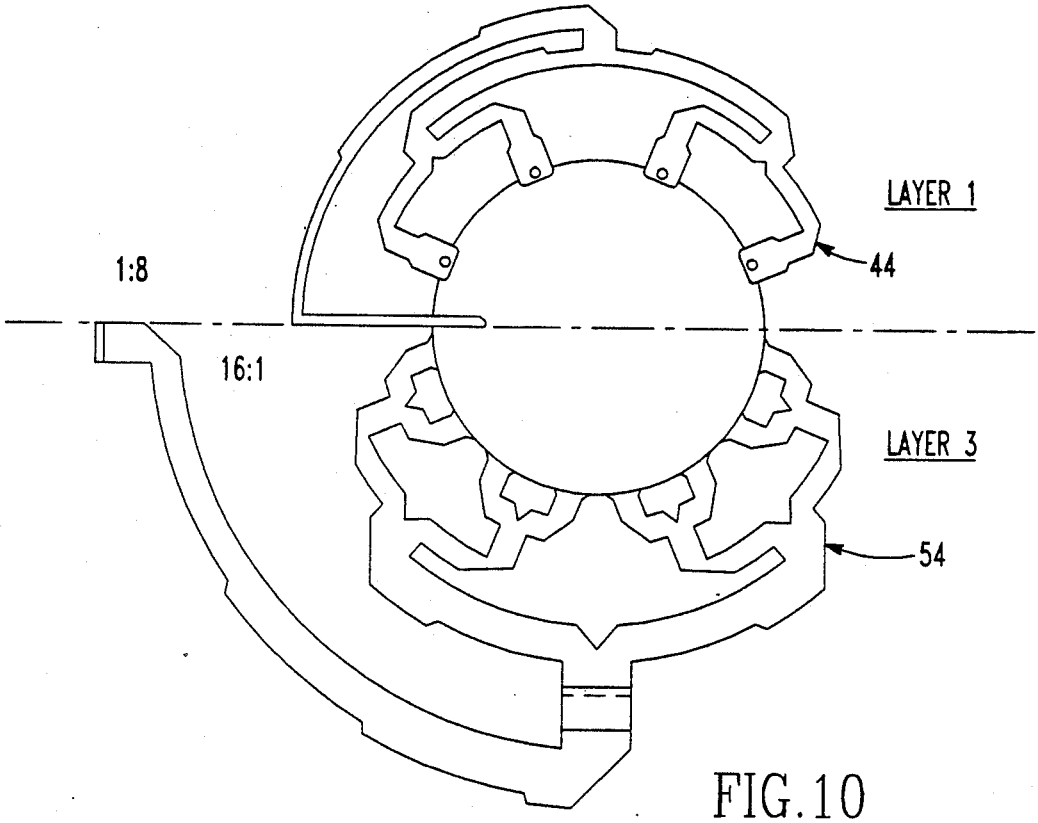
FIG. 10 shows a comparison of the divider of Layer 1 and the combiner of Layer 3, both of the present invention.

FIG. 10 shows how the combiner 54 of Layer C compares with the divider 44 of Layer A. The assembly has a modest diameter with half the height of that which the prior art would require for the same power handling capability.

This design uses a bare minimum of all-metal (e.g. aluminum) line of quite large dimensions, which minimizes resistive loss and differential expansion due to heat. Because a conductor with twice the cross sectional area has four times the power handling capability, this makes it practical to handle large average power with only air cooling, while simultaneously allowing a clear passage for forced air through the stripline from input to output.

For the sizes envisioned in the 21-channel high power stack 32, a total r.f. line length of approximately ten feet is expected. Meeting an example goal of no more than 3000 watts dissipated would require a loss of less than 0.32 dB. This is an average of 0.032 dB/ft. Additional losses inevitably occur due to contacts, bends where current concentrations occur, chokes, baluns, beads, and reflections, so that a theoretical design goal of half this value (0.016 dB/ft.) is reasonable for the stripline. Furthermore, loss increases with temperature. For aluminum, if the average temperature rise were 50 degrees C., the loss rise would be 9.3%. A realistic design goal would therefore be 0.0146 dB/ft.

Aluminum air dielectric stripline with 0.9" ground plane spacing and 3/16" thick 50 ohm strips has a theoretical loss of 0.011 dB. This may be selected as the basic transmission line, allowing higher loss line where necessary, as in the divider 44 (preferably 100 ohm sections), the extruded spline 35, and for smaller lines in critical passages.

Air dielectric stripline is widely used in both milled and stamped forms, but in this high-power, thick-strip, curved-line application, milling is the preferred choice. A benefit of milling is that the circuit edges can be radius cut, which significantly increases the peak power capacity of the stripline.

Figure 11A:
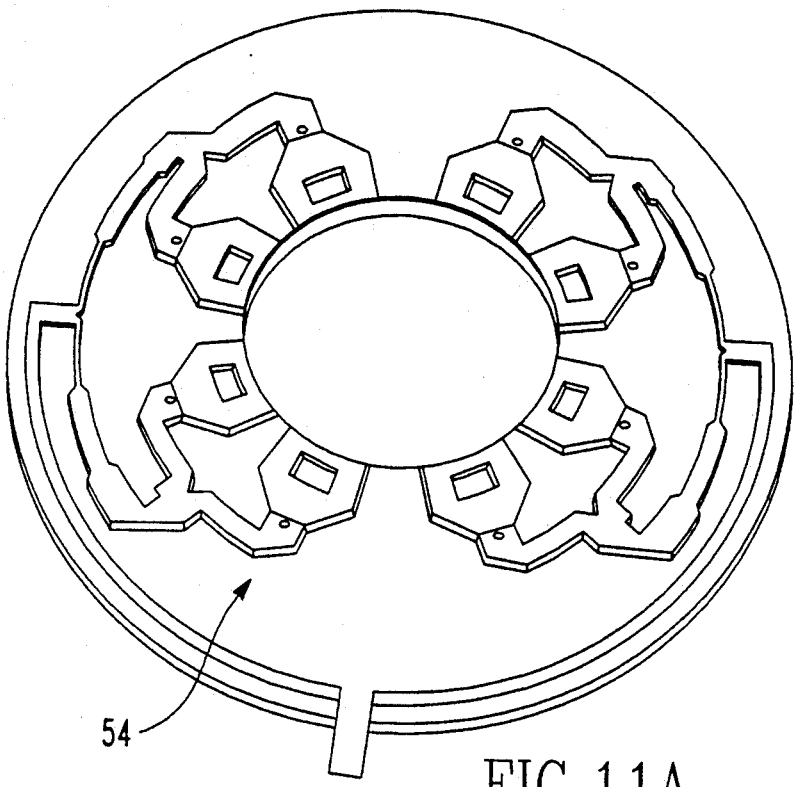
FIGS. 11*a* and 11*b* show the divider and combiner circuitry of the present invention, respectively.
Figure 11B:
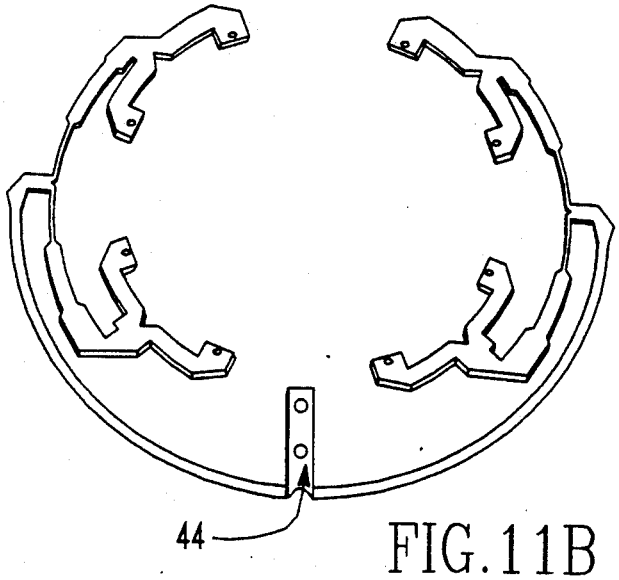

FIGS. 11*b* and 11*a* show the divider and combiner channel circuitry of Layers A and C, respectively. Sixteen taps are used on the combiner side 54 and 8 taps are used on the space-constrained divider side 44. By using an 8:1 divider side 44, the divider side 44 can be designed so that it shares Layer A with the combiner choke 50. Using these taps, the output signal attenuation necessary for proper isolation can be obtained. An example goal for output signal attenuation of the present invention is 40 dB.

The amount of attenuation provided can be calculated in the following manner. The low impedance coax has a known outer diameter and circumference. At the highest frequency present the drive points must still be spaced a fraction of a wavelength apart. If they are, and if they are driven equally, the lowest order undesired mode that is excited will be attenuated by an amount proportional to the coax length and inversely proportional to the tap spacing. For example, if the low impedance coax has an outer diameter of 8.5" and therefore a circumference of approximately 27", and if the maximum effective coax length is about 1.25", 16 drives will result in the approximately 40 dB of attenuation needed.

For matching purposes, the 1:8 divider 44 and the 16:1 combiner 54 can be considered as impedance transformers between 50 ohms and the 7.4 ohms of the vertical coax. Computer programs are available for optimum N-step transformers from which the ideal impedances were obtained.

Figure 12:
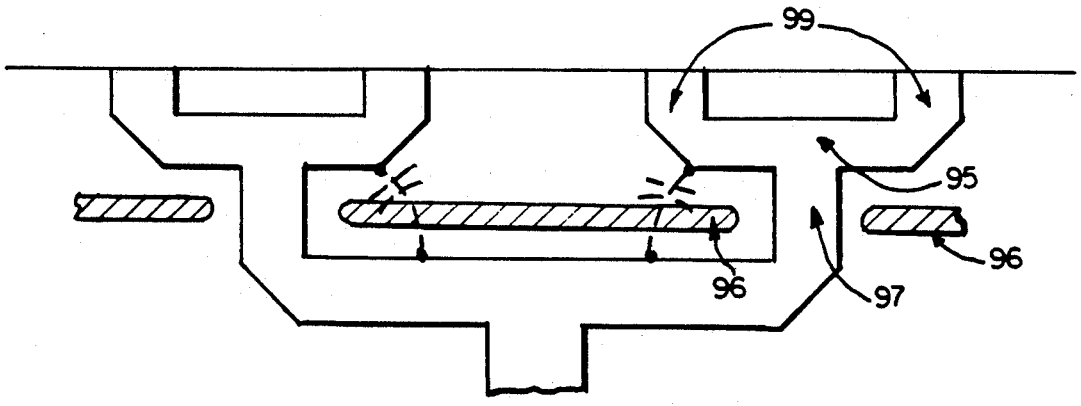
FIG. 12 is a top view of the ground shield at the divider tap of the present invention.
Figure 13:
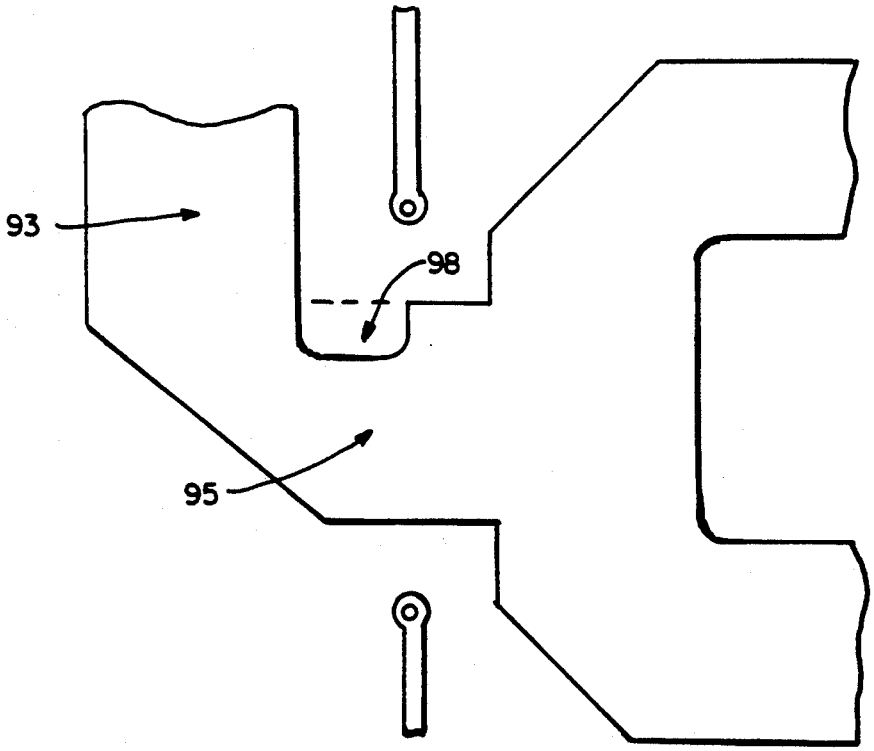
FIG. 13 shows the path length correction through the large divider and combiner junctions of the present invention.

A six step, 5 section transformer was selected by this method. These impedances must be fitted to the configuration of the binary tees in the divider 44 and combiner 54. Thus, the impedances are modified by a factor of 2, 4, or 8 depending on the number of branches at that location. Whereas the modes excited by having a finite number of taps on the central coax are below cutoff, any unbalance in the divider 44 can excite propagating modes. These suffer no attenuation in the coax and therefore must be eliminated. Two steps have been taken as indicated in FIGS. 12 and 13, which show a typical junction of the divider 44 (as shown in FIG. 11*b*). First, as shown in FIG. 12, to avoid asymmetrical capacitance from the input line 97 of a junction 95 to the two output lines 99, shields 96 between the ground planes have been provided close to the junction 95. These shields 96 also serve to guide cooling air in that they define air ducts. Second, as shown in FIG. 13, because the input lines 97 are so wide, the large junctions 95 are preferably shaped, 98, to correct differences in path length through them. This would be unnecessary with conventional low power lines, but it is a step that benefits the high power channels 11.

Figure 14:
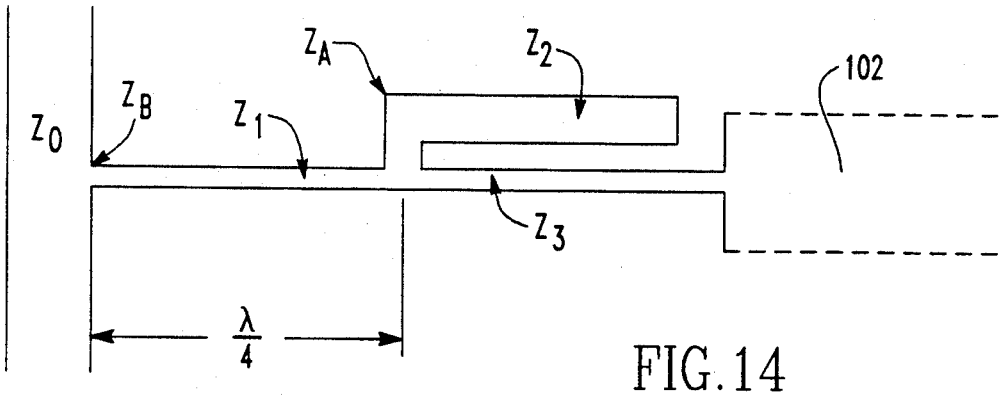
FIG. 14 is a choke design schematic of the present invention, showing relative impedance values of portions of the chokes.

The chokes that allow contact-free rotation have two basic requirements: low VSWR in the main line and high isolation to the outside world. Network analysis computer programs have been used to select dimensions for each purpose. A choke joint also has the objective of appearing short circuited at the input despite uncontrollable impedance at the output terminals. It is normally accomplished by a sequence of low and high impedance lines having the output tied in series with a high impedance point. FIG. 14 shows a choke design according to the embodiment of FIG. 9. As shown in FIG. 14, if the short circuited high impedance section $Z_1$ is one quarter wavelength long, it appears open circuited at the series junction with the outside 102. The sum of the two loads is a high impedance $Z_A$ and transforms through $Z_1$, to $Z_B=Z_1^2$, which is very low.

Over a wide bandwidth the electrical lengths vary and the operation is imperfect. For the large bandwidth and low VSWR required of the example rotary joint 21, it is necessary to maintain a 10:1 ratio of $Z_0/Z_1$ and $Z_2/Z_1$. $Z_0$ and $Z_2$ are limited by the available volume and $Z_1$ by the mechanical tolerance. A good compromise is to use 0.5" spacing for $Z_0$ and $Z_2$, and 0.05" for $Z_1$. The choke is properly located such that the residual reactance variation is integrated into the matching of the main line. There is unavoidably a continuous path from one channel to another through one choke and out the other. Rather than using lossy material in this path to attenuate this leakage, the outside path has been designed with the $Z_3$ section, which transforms down the impedance inside the case before it joins the high impedance $Z_2$ path. The $Z_3$ path has a 0.05" gap, but since it occurs at a larger circumference, $Z_3$ is even lower than $Z_1$.

Network analysis predicts the isolation between channels to be over 80 dB via the choke path. Small but finite leakage occurs by other paths as well.

Figure 15:
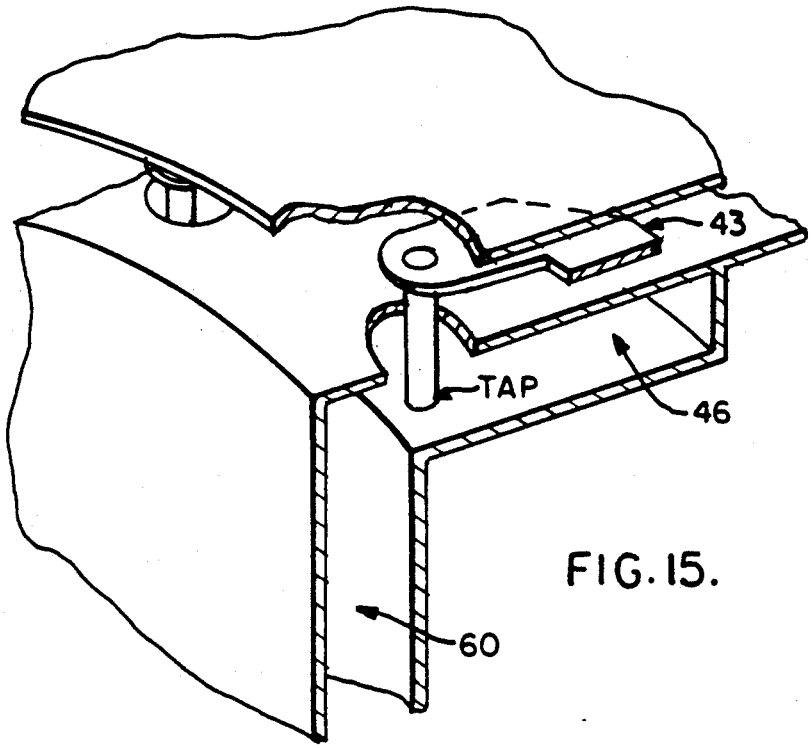
FIG. 15 is a drawing of the return to center junction as made through a pan in the divider in Layer 1 of the present invention.
Figure 16:
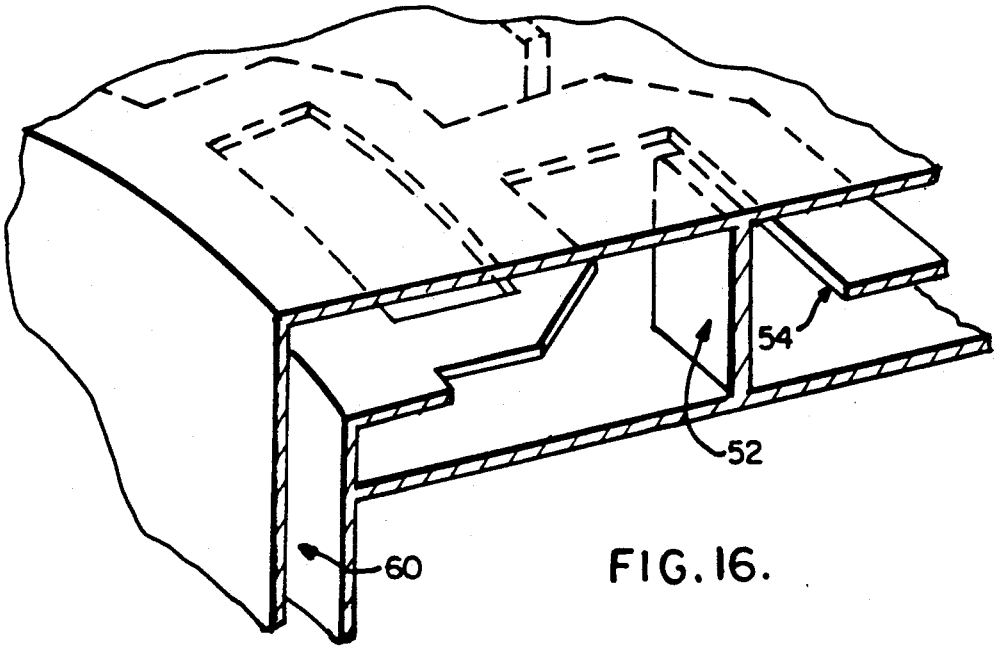
FIG. 16 is a shows how the combiner space is shared with the combiner balun in Layer 3 of the present invention.

The connection from divider 44 to central coax 60 is the junction of an unbalanced (3-wire) stripline to a balanced (2-wire) segment of the coax. Such junctions require baluns (balancing transformers) to equalize the voltage on the two stripline ground planes. The central coax 60 can be considered to be a collection of balanced parallel 2-wire lines driven at 8 divider locations around the periphery of the stationary portion of the central coax, and connected at 16 combiner locations around the periphery of the rotary portion of the coax 60. The balanced 2-wire coax portions 60 must be coupled with a Balun to the 3-wire striplines in the feed or input side and on the output side is connected to the rotating device. A variety of designs exist for this purpose, almost all of which involve a quarter-wavelength section of short circuited line. FIGS. 15 and 16 show the two novel designs used here and previously shown in FIG. 9. As shown in FIG. 15, the divider balun 46 exists in its own cavity while, as shown in FIG. 16, the combiner balun 52 shares space with the stripline comprising combiner 54.

In each case bandwidth is maximized if the cavity is of high impedance, and the residual frequency-sensitive reactance can be incorporated into the junction design.

Figure 17:
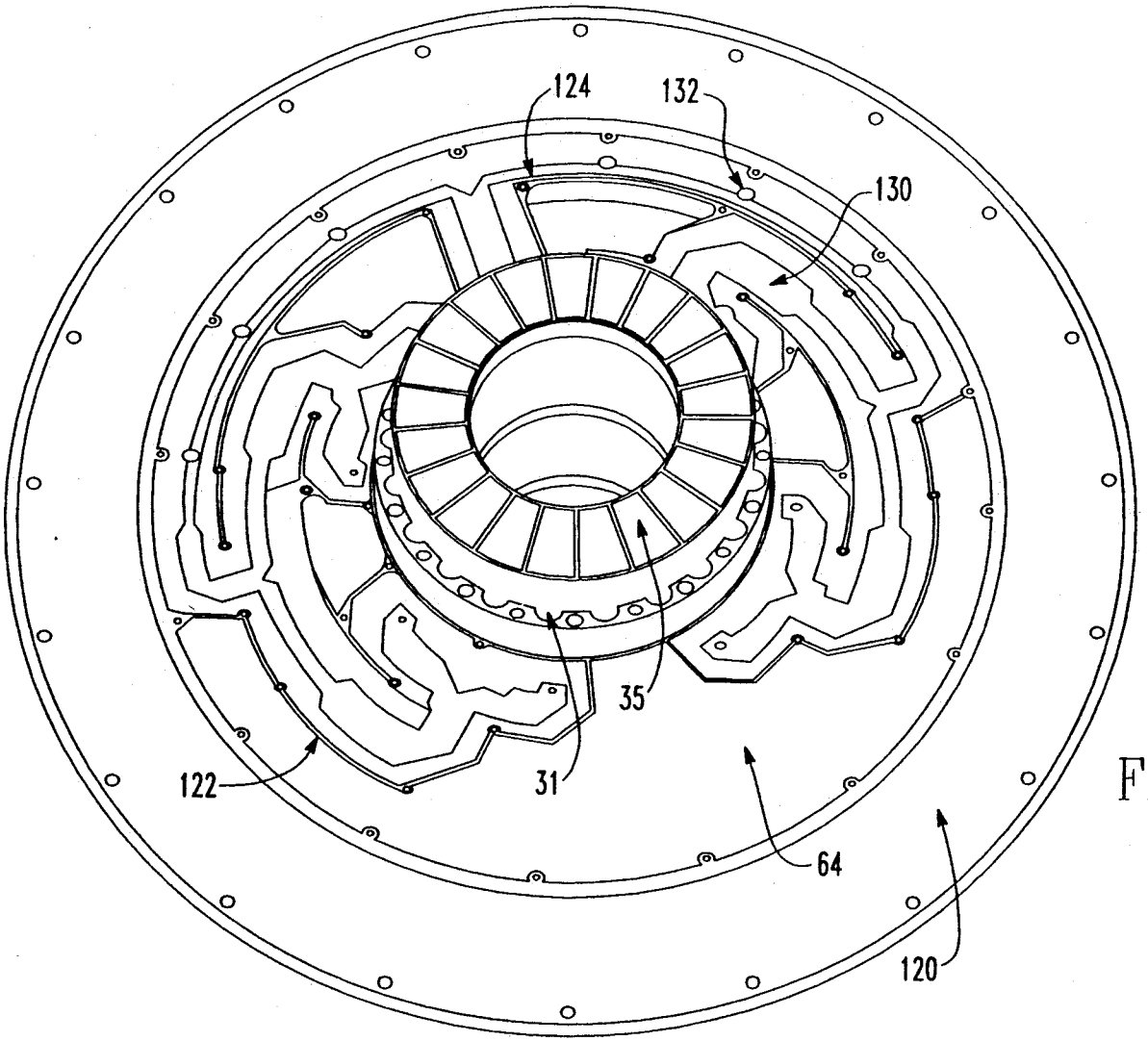
FIG. 17 shows the stationary housing breadboard with the divider circuitry and central extruded spline in place, Layer 1 of the present invention.
Figure 18:
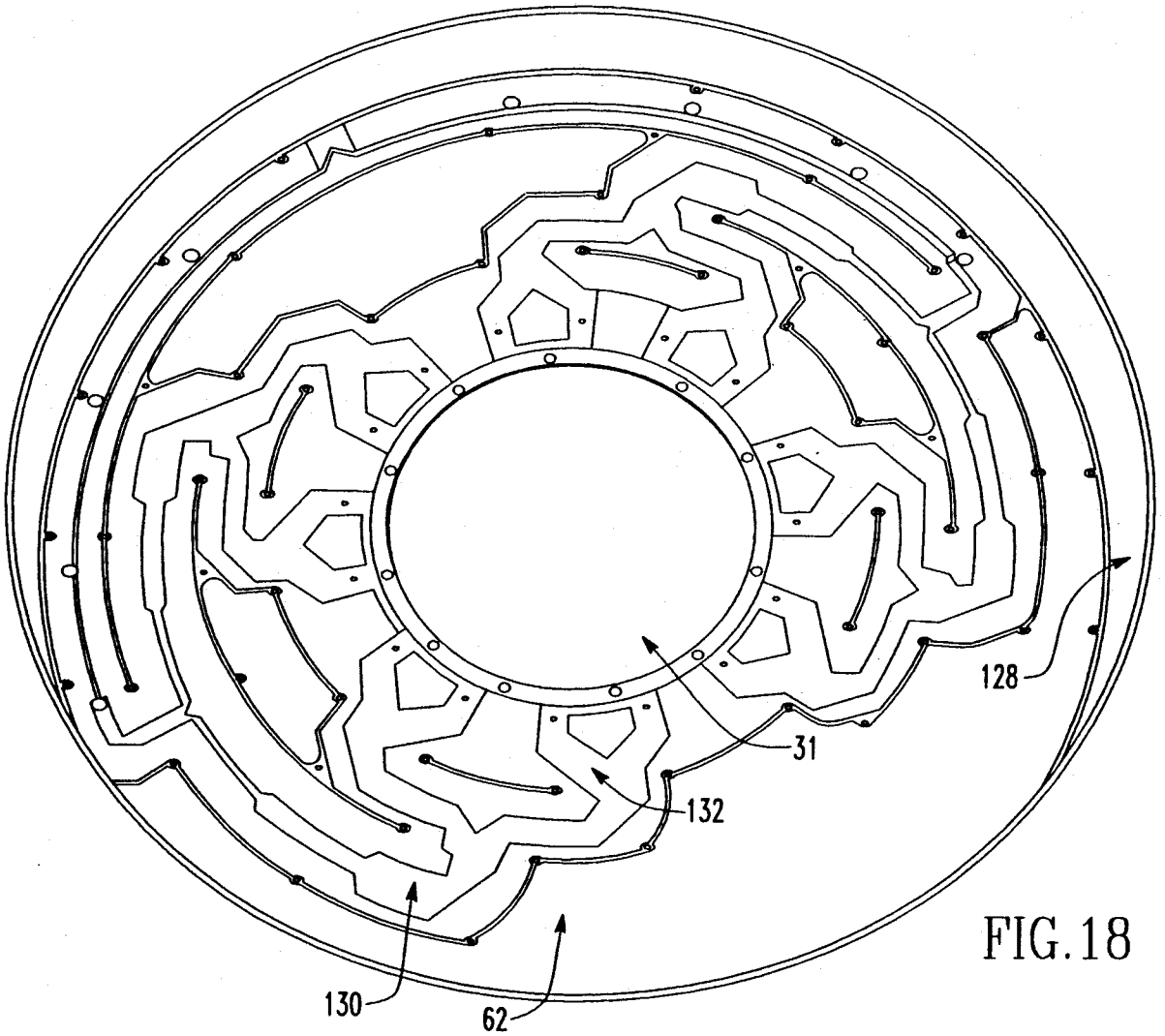
FIG. 18 shows the rotary housing breadboard with the combiner circuitry in place, Layer 3 of the present invention.

FIGS. 17 and 18 show the stationary and rotary housings, respectively, of the high power channel 11 with the circuits in place. Referring to FIG. 17, the stationary backbone 64 consists of a center hole 31 holding extruded spline 35, and the main horizontal disk 120. Horizontal disk 120 is heavily reinforced with webs 122 that simultaneously serve as ribs, spacers, thermal baffles, and electrical shields. Horizontal disk 120 is a very stiff section, with closely spaced tapped holes 124 to receive the upper plate 125 and lower plate 126 (see FIG. 8) that bound the stripline compartments and the chokes. As shown in FIG. 17, the rotating backbone 62 is similar to the stationary backbone 64 with the hub on the outside diameter 128.

The stripline center conductor 130 as shown is made stiff. The stripline center conductor 130 may be a 0.188" thick aluminum plate numerically machined with a 3/32" radius into the intricate pattern shown, which is required for equal power division to the circular passageway. The stripline center conductor 130 is periodically supported with TEFLON posts 132. The rotating circuit is produced preferably by vapor welding the stripline divider 44 to the ground plane, as this is the most efficient way of attaching the two components.

The center structure, extruded spline 35, is made of seven extruded sections each with three cavities which are bonded together end to end to form the extruded spline 35 of FIG. 5. Since this section is being used to control the concentricity of the channels, the outside diameter is preferably machined after assembly. There is a center conductor 36 for each of the channels which runs in its own cavity.

Along with major parts there are three sheet metal covers, strip line vertical/horizontal transition pieces and bearing housing pieces. These parts are all made on numerically controlled machines to improve repeatability.

Once the extruded spline 35 has been assembled, the lower bearing 37 and its support are attached and then the stationary backbone 64 of the bottom high power channel 11 is assembled to the extruded spline 35. The divider 44 is then connected to the vertical stripline 36. The rotating backbone 62 is then lowered over the extruded spline 35 onto the stationary backbone 64. Subsequent high power channels 11 are similarly assembled, with each stationary backbone 64 indexed in azimuth with the adjacent stationary backbone 64. The indexing will be accomplished by having a tab on the upper stationary backbone 64 fit into a notch on the stationary backbone 64 below it, orienting the output striplines 56 in azimuth. When all high power channels 11 are attached to the extruded spline 35, the top bearing 37 and its support are attached to the extruded spline 35 and the rotating backbone 62.

Figure 19B:
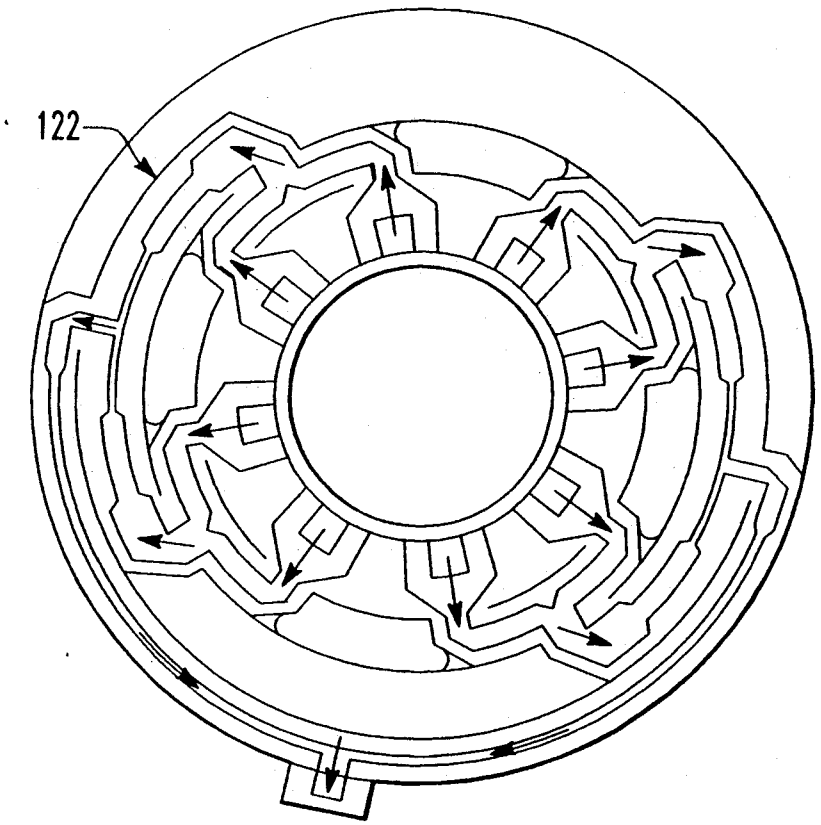
FIGS. 19*a* and 19*b* are diagrams of the channel air flow through the stationary and rotary channel housings respectively, showing where air baffles were added to control the air flow.
Figure 19A:
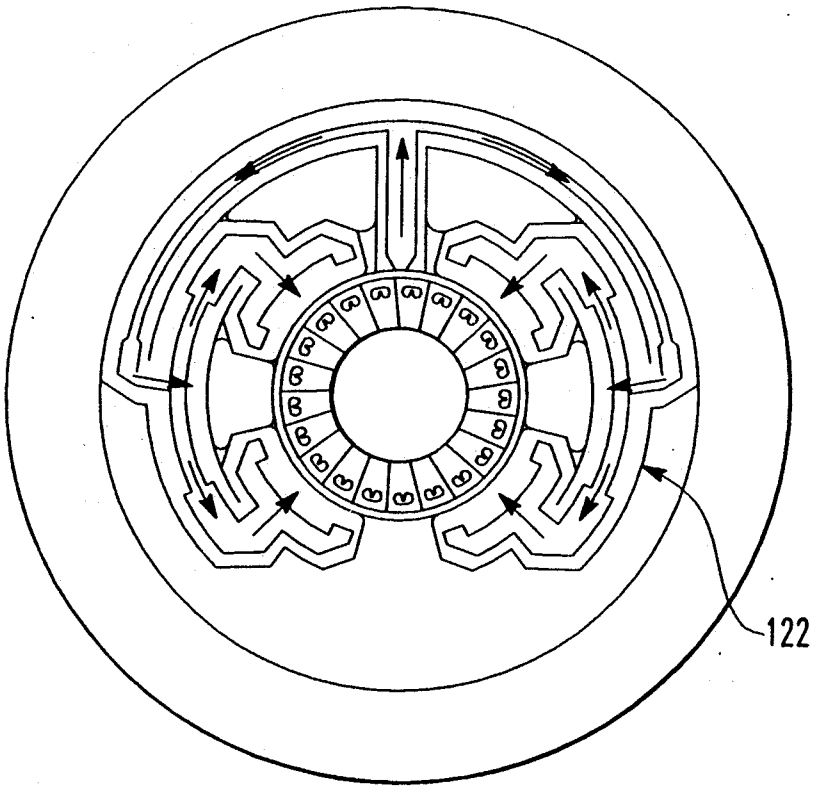

The rotary joint 21 of the present invention preferably incorporates forced air cooling, using preheated air to minimize corrosion due to moist air. Forced air cooling is preferred as it can be implemented more reliably than liquid cooling. Since the cooling design is simpler, there is an added benefit of cost savings and weight reduction. The thermal design must limit both the air temperature rise and the local temperature of the local conductors. The air temperature rise is established by the total power dissipation and total air flow, relatively independent of the number of channels in which the power is expended. However, the local temperature rise does depend on power per channel. The heat loss can be separated into three sections: the input section, the channel, and the output section. On both the input and output sections, each channel is narrowed to a single passage with relatively high flow rates and thus more heat transfer. In the channel section, air baffles (webs 122) were added to control the air flow as shown in FIG. 19*a* and 19*b*. As the air flow is split, the amount of heat dissipated in a given area is reduced.

The ambient air will preferably be heated and filtered before it enters the air cooling system blower 144 in order to minimize corrosion due to moist air.

Figure 20:
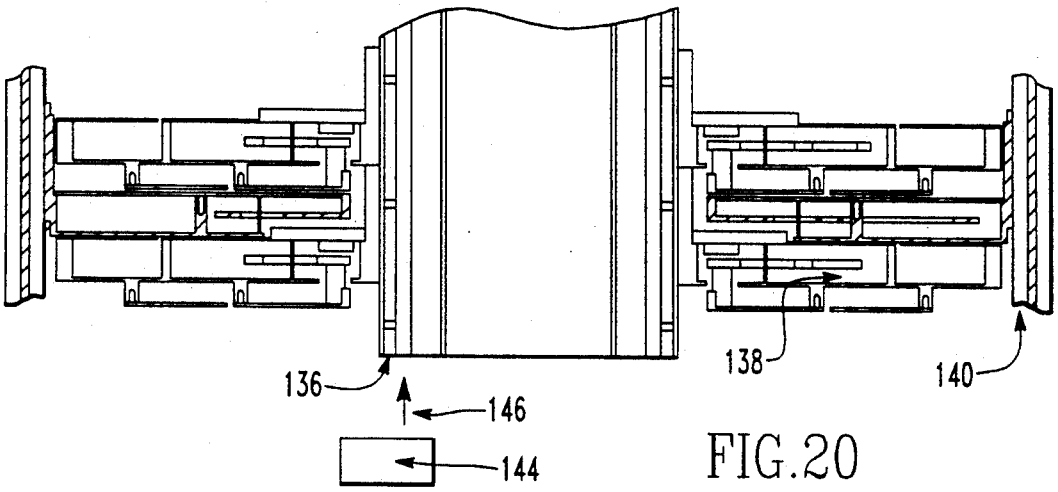
FIG. 20 is a cross-section of a high power channel of the present invention, showing the general components of the air cooling system.
Figure 21:
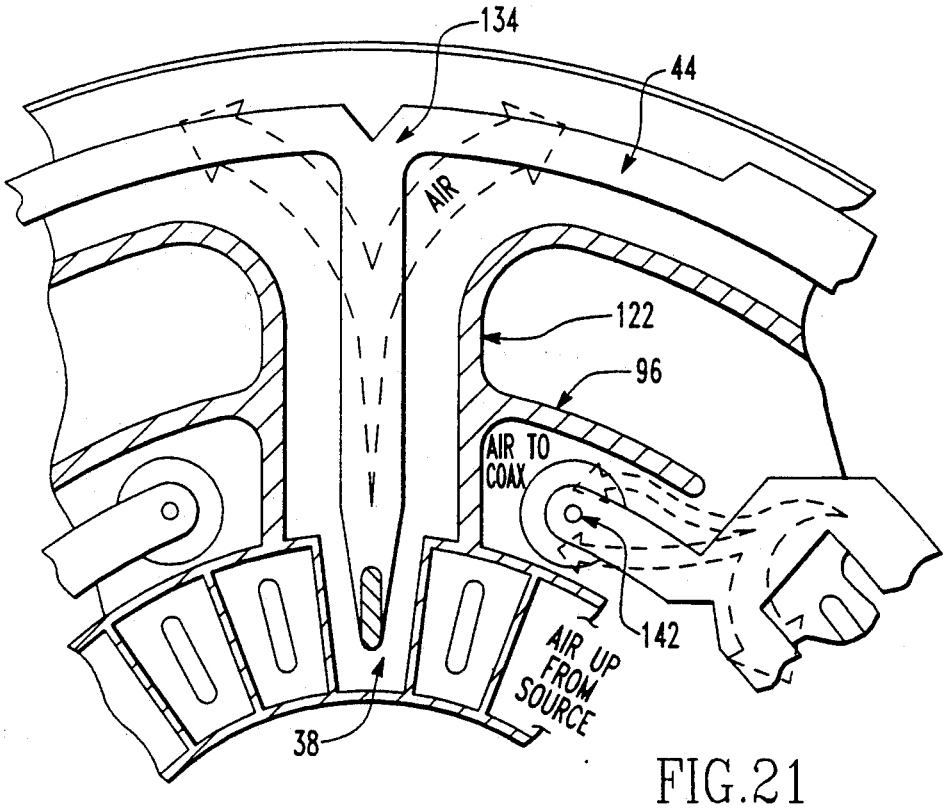
FIG. 21 is a top view of a portion of Layer 1 of the present invention, showing in particular the ducts used to direct air flow through the divider.

The heat transfer from the rotary joint 21 occurs in three major areas, as shown in cross-section in FIG. 20: the inlet tube 136 (extruded spline passage 38), the channel section 138, and the outlet tube 140 (output extrusion passage). The cooling air 146 is first directed into the inlet tube 136 by the air cooling system blower 144. It then flows to the channel sections 138 of the rotary joint 21, where it divides and combines with the stripline (as shown in FIGS. 19*a* and 19*b*), dissipating heat in the process. The cooling air 146 then passes to the outlet tube 140. Because of the geometry of these structures, air velocities will be relatively high through the inlet and outlet tubes 136 and 140, and relatively low in the channel sections 138, which are larger in area. As shown looking into Layer 1 from above in FIG. 21, the shields 96 used to shield the divider input junction 134 from the outputs 142 define ducts, webs 122, to direct the air flow through the divider 44. Similar provisions are made in the remaining layers. The result is a nearly uniform temperature throughout the rotary joint 21.

STATEMENT OF INDUSTRIAL APPLICABILITY

The present invention is a multiple channel radar joint with many potential applications. The radar joint has particular application in high power, wide bandwidth, shipboard transmission applications.

I claim:

1. An improved rotary coupler for transmitting microwave signals between a signal processing device and a device rotatable relative to the signal processing device, comprising:

a plurality of joint means arranged in a stack of predetermined dimension one above another between the signal processing device and the rotatable device, each joint means having a fixed stator portion and a rotatable rotor portion with the stator portions of each of the joint means in the stack being fixed together and the rotor portions of each of the joint means in the stack also being fixed together;

feeder means associated with each stator portion for connecting signal paths from the signal processing device to the associated joint means;

rotatable device interface means associated with each rotor portion for connecting said signal paths from the associated joint means to the rotatable device; and said feeder means including a cylindrical structural means of predetermined length which is the same as the stack dimension of said plurality of joint means, said cylindrical structural means comprises an outer circumferential wall, an inner circular hub wall located within and coaxial with the outer circumferential wall and defining a central feeder passage, a plurality of radially extending walls disposed between the inner circular hub wall and the outer circumferential wall to define a plurality of passages for carrying individual feeder signal paths from the signal processing device to said associated joint means, with a passage for each joint means;

a pair of bearings, an associated bearing of the pair is disposed at each end of the stacked joint means thus permitting the rotor portions of the associated joint means in the stack to rotate as a group relative to the stator portions of the associated joint means in the stack, the number of bearings being less than the number of joints in the stack.

2. The coupler of claim 1 wherein continuous cooling air passages are provided through each joint means beginning at the feeder means associated with the joint means.

3. A rotary coupler for transmitting microwave signals between a signal processing device and a device rotatable relative to the signal processing device, comprising at least one joint including a fixed stator portion and a rotatable rotor portion, each joint comprising:

divider means connected to the signal processing device and having a plurality of divider signal taps, for dividing an input signal from the signal processing device into a plurality of divided signals at the divider signal taps;

central transmission means connected to the divider means for carrying the plurality of divided signals between the rotor and stator portions of the joint;

combiner means connected to the central transmission means and connected to the rotatable device and having a plurality of combiner signal taps for receiving the plurality of divided signals from the central transmission means and providing a combined output signal;

wherein the number of signal taps of the divider means is half of the number of signal taps of the combiner means.

4. An improved rotary coupler for transmitting microwave signals between a signal processing device and a device rotatable relative to the signal processing device, comprising:

a plurality of joint means, including first and second joint means, arranged in a stack one above another between the signal processing device and the rotatable device, each joint means having a rotor portion rotatable about an axis and a fixed stator portion incorporating a feed region located along said axis for accommodating feeder signal paths from the signal processing device to said plurality of joint means, each said feed region having an associated cross sectional area;

feeder means associated with each stator portion for connecting said signal paths from the signal processing device to the associated joint means;

rotatable device interface means associated with each rotor portion for connecting said signal paths from the associated joint means to the rotatable device;

wherein the first joint means is located above the second joint means in the stack and the feed region of the first joint means has lesser cross-sectional area than the feed region of the second joint means.

5. The coupler of claim 4 wherein there are a plurality of high power joint means including said second joint means and a plurality of low power joint means including said first joint means, with the high power joint means operating to transmit signals of higher power than the low power joint means, wherein the low power joint means are located closer to the rotatable device than the high power joint means and the feed region of each low power joint means has a lesser cross sectional area than the feed region of each high power joint means.

6. The coupler of claim 4 further including an elongated central structural means of predetermined length which carries said signal paths from the signal processing device to the feeder means of each joint means, the central structural means defining the boundaries of said feed region.

7. The coupler of claim 6 wherein the central structural means also transmits cooling fluid from a cooling fluid source to each joint means.

8. The coupler of claim 6 wherein the central structural means has a constant cross section along a substantial part of said predetermined length along the axis of rotation of said rotatable device.

9. The coupler of claim 6 wherein the central structural means is generally cylindrical and has an outer circumference and a central longitudinal axis coincident with the axis of rotation of said rotatable device, with a plurality of separated passages disposed about said outer circumference for carrying individual feeder signal paths from the signal processing device to a specified joint means.

10. The coupler of claim 9 wherein the feeder signal paths constitute coaxial stripline located in the separated passages.

11. The coupler of claim 9 wherein the central structural means further has a central feeder passage along the central longitudinal axis for carrying a plurality of signal paths from the signal processing device to a portion of said rotating device located farther from the signal processing device than the joint means through which the central feeder passage passes.

12. The coupler of claim 11 wherein the central structural means is a generally cylindrical member having a constant cross section along a substantial part of said predetermined length along said central longitudinal axis comprising an outer circumferential wall, an inner circular hub wall located within and coaxial with the outer circumferential wall and defining the central feeder passage, and a plurality of radial walls extending between the outer circumferential wall and the inner circular hub wall to define, with the outer circumferential wall and the inner circular hub wall, the separated passages.

13. The coupler of claim 12 wherein the radial wall are planar, and the radial walls defining planes which pass through the central axis of the cylindrical member.

14. The coupler of claim 12 wherein at least one of the separated passages carries cooling fluid from a cooling fluid source to a corresponding one of the joint means associated with the separated passage.

15. A rotary coupler for transmitting microwave signals between a signal processing device and a device rotatable relative to the signal processing device, comprising a plurality of joints each including a fixed stator portion and rotatable rotor portion, each joint comprising the following components:

divider means connected to the signal processing device and having a plurality of divider signal taps, for dividing an input signal from the signal processing device into a plurality of divided signals at the divider signal taps;

central transmission means connected to the divider means for carrying the plurality of divided signals between the rotor and stator portions of the joint;

combiner means connected to the central transmission means and connected to the rotatable device and having a plurality of combiner signal taps for receiving the plurality of divided signals from the central transmission means and providing a combined output signal;

wherein said components of each joint are arranged with said components located on a plurality of planar levels disposed vertically one above the other, and at least a portion of one of the joints shares a planar level with at least a portion of an adjacent joint.

16. A rotary coupler for transmitting microwave signals between a signal processing device and a device rotatable relative to the signal processing device, comprising a plurality of joints each including a fixed stator portion and a rotatable rotor portion, each joint comprising:

divider means connected to the signal processing device and having a plurality of divider signal taps, for dividing an input signal from the signal processing device into a plurality of divided signals at the divider signal taps;

central transmission means for carrying the plurality of divided signals between the rotor and stator portions of the joint;

divider balancing means connected to the divider means and the central transmission means for providing an unbalanced to balanced signal junction between the divider means and the central transmission means;

choke means connected to the central transmission means for providing signal continuity between the rotor and stator portions of the joint;

combiner means connected to the rotatable device and having a plurality of combiner signal taps for receiving the plurality of divided signals from the central transmission means and providing a combined output signal;

combiner balancing means connected to the central transmission means and to the combiner means for providing a balanced to unbalanced signal junction between the central transmission means and the combiner means;

wherein said components of said joints are arranged with said components located on a plurality of substantially planar levels disposed vertically one above the other, and at least a portion of one of the joints shares a planar level with at least a portion of an adjacent one of the joints.

17. The coupler of claim 16 wherein the combiner means and the combiner balancing means are located on the same planar level.

18. The coupler of claim 16 wherein continuous cooling air passages are provided through each joint beginning at the divider means of the joint.

19. The coupler of claim 16 wherein the divider balancing means and a portion of the choke means of the same joint are located on the same planar level.

20. The coupler of claim 16 wherein the divider means of one joint and a portion of the choke means of a different joint are located on the same planar level.

21. The coupler of claim 16 wherein the choke means comprises divider choke means associated with the divider means and connected to the central transmission means, and combiner choke means associated with the combiner means and rotatably disposed about the central transmission means.

22. The coupler of claim 21 wherein the divider means of one joint and the combiner choke means of a different joint are located on the same planar level.

23. The coupler of claim 21 wherein the divider balancing means and at least a portion of the divider choke means of said joint are located on the same planar level.

24. The coupler of claim 16 wherein each joint comprises an annular disk with an inner annular stator portion and a concentric outer rotor portion thereabout, with the annular stator portion defining a central signal feed region of predetermined cross-sectional area, wherein said inner annular stator portion of said joint is stationary with respect to the signal processing device, said stator portion central signal feed region of each joint accommodates feeder signal paths from the signal processing device to the various joints, and with the joints being arranged in a stack one above another between the signal processing device and the rotatable device.

25. The coupler of claim 24 wherein the stack has first and second ends and a first bearing means is provided at a first end of the stack and a second bearing means is provided at a second end of the stack, with the stator portions of each of the joints in the stack being fixed together with the rotor portions of each of the joints in the stack also being fixed together, wherein the first and second bearing means permit the rotor portions of the joints in the stack to rotate as a group relative to the stator portions of the joints in the stack.

26. The coupler of claim 24 wherein the plurality of joints include at least first and second joints with the first joint located above the second joint in the stack and the center signal feed region of the first joint has lesser cross-sectional area than the center signal feed region of the second joint.

27. The coupler of claim 26 wherein said first joint comprises a plurality of low power rotary means for transmitting low power signals between the signal processing device and the rotatable device, the low power signals being of lower power than the signals transmitted by said second joint, wherein the lower power rotary means are located closer to the rotatable device than said second joint and said center signal feed region of each low power rotary means has a lesser cross sectional area than said center signal feed region of said second joint.

28. The coupler of claim 24 further including a central structural means which carries signal paths from the signal processing device to the feeder means of each joint means, with the central structural means defining the boundaries of said feed region.

29. The coupler of claim 28 wherein the central structural means has a constant cross section along a substantial part of said predetermined length along the axis of rotation.

30. The coupler of claim 28 wherein the central structural means also transmits cooling fluid from a cooling fluid source to each joint.

31. The coupler of claim 28 wherein the central structural means is generally cylindrical and has an outer circumference and a central longitudinal axis, with a plurality of separated passages disposed about said outer circumference for carrying individual input signal paths from the signal processing device to a specified joint.

32. The coupler of claim 31 wherein the input signal paths constitute coaxial striplines located in the separated passages.

33. The coupler of claim 31 wherein the central structural means is a generally cylindrical member having a constant cross section along a substantial part of said predetermined length along said central longitudinal axis and comprising an outer circumferential wall, an inner circular hub wall located within and coaxial with the outer circumferential wall and defining the central feeder passage, and a plurality of radial walls extending between the outer circumferential wall and the inner circular hub wall to define, with the outer circumferential wall and the inner circular hub wall, the separated passages.

34. The coupler of claim 33 wherein the radial walls are planar, and the radial walls defining planes which pass through the central axis of the cylindrical member.

35. The coupler of claim 33 wherein at least a corresponding one of the separated passages carries cooling fluid from a cooling fluid source to one of said joints associated with the separated passage.

36. A rotary coupler for transmitting microwave signals between a signal processing device and an antenna rotatable relative to the signal processing device, comprising a plurality of joints, each joint including a fixed stator portion and a rotatable rotor portion and having at least a first layer, a second layer and a third layer, the first, second, and third layers being substantially planar and arranged one above another, each joint comprising the following components:

divider means connected to the signal processing device and having a plurality of divider signal taps, for dividing an input signal from the signal processing device into a plurality of divided signals at the divider signal taps;

central transmission means for carrying the plurality of divided signals between the rotor and stator portions of the joint;

divider balancing means connected to the divider means and the central transmission means for providing a signal junction between the divider means and the central transmission means;

combiner means connected to the antenna and having a plurality of combiner signal taps for receiving the plurality of divided signals from the central transmission means and providing a combined output signal;

combiner balancing means connected to the central transmission means and to the combiner means for providing a signal junction between the central transmission means and the combiner means;

choke means connected to the central transmission means for providing signal continuity between the rotor and stator portions of the joint, comprising divider choke means associated with the divider means and combiner choke means associated with the combiner means;

wherein the first layer includes the divider means and a space for the combiner choke means of an adjacent joint, the second layer includes the divider balancing means and the divider choke means, and the third layer includes the combiner means and the combiner balancing means.

37. The coupler of claim 36 wherein the first layer is above the second layer, which is above the third layer.

38. The coupler of claim 36 wherein each joint is in the form of a disk having a center portion with the rotor portion thereof rotatable about a central axis passing through the center portion, with the rotor portion generally farther from the axis than the stator portion so that the center portion of the disk is stationary with respect to the signal processing device, with the stator portion of each joint having a feed region located at the center portion of the disk for accommodating signal paths from the signal processing device to the various joints, and with the joints being arranged in a stack one above another between the signal processing device and the rotatable device.

39. The coupler of claim 38 further including a central structural means which carries said signal paths from the signal processing device to each joint, the central structural means defining the boundaries of said feed region.

40. The coupler of claim 39 wherein the central structural means is generally cylindrical and has an outer circumference and a central longitudinal axis, with a plurality of separated passages disposed about said outer circumference for carrying individual input signal paths from the signal processing device to a specified joint.

41. The coupler of claim 40 wherein the central structural means is a generally cylindrical member comprising an outer circumferential wall, an inner circular hub wall located within and coaxial with the outer circumferential wall and defining the central feeder passage, and a plurality of radial walls extending between the outer circumferential wall and the inner circular hub wall to define, with the outer circumferential wall and the inner circular hub wall, the separated passages.

42. The coupler of claim 40 wherein at least one of the separated passages carries cooling fluid from a cooling fluid source to a specified joint associated with the separated passage.

* * * * *